United States Patent [19]

Pemberton

[11] 4,423,997

[45] Jan. 3, 1984

[54] GRAPPLE MECHANISM

[76] Inventor: Walter B. Pemberton, 682 Gladwin Ave., Fern Park, Fla. 32703

[21] Appl. No.: 357,893

[22] Filed: Mar. 15, 1982

[51] Int. Cl.[3] ..... E02F 3/70

[52] U.S. Cl. ..... 414/697; 414/622; 414/704; 414/712; 414/722

[58] Field of Search ..... 294/88, 104; 414/697, 414/622, 740, 722, 724, 707, 710, 712

[56] References Cited

U.S. PATENT DOCUMENTS

| | | | |
|---|---|---|---|
| 3,182,833 | 5/1965 | Lull | 414/697 X |
| 3,369,680 | 2/1968 | Peterson | 414/697 |
| 3,935,953 | 2/1976 | Stedman | 414/697 |
| 4,156,488 | 5/1979 | Stark | 414/697 |

FOREIGN PATENT DOCUMENTS

| | | | |
|---|---|---|---|
| 857502 | 11/1969 | Canada | 414/622 |

*Primary Examiner*—Robert J. Spar
*Assistant Examiner*—Terrance L. Siemens
*Attorney, Agent, or Firm*—William M. Hobby, III

[57] ABSTRACT

A grapple operating mechanism (12) is attached to a vehicle (10), such as a front end loader, and includes a boom (26) rotatably attached to the vehicle (10) and a pipe and pole type grapple (11) attached to the other end of the boom (25). A boom actuating mechanism (29) is connected between the vehicle (10) and the boom (25) for moving the boom (25) relative to the vehicle (10) and a grapple actuating mechanism (33,35,36,37,38,40) is connected between the vehicle (10) and grapple to rotate the grapple (11) on the boom (25). The grapple actuating mechanism has one or more actuating cylinders (33) connected to a first set of arms (36) attached to the boom (25). A first linkage (37) is connected between the first set of arms (36) and a second set of arms (38) and a second linkage (40) is connected between the second set of arms (38) and the grapple (11), so that actuating the cylinder (33) will move the first and second arms (36, 38) and the first and second linkage (37, 40) to rotate the grapple (11) on the boom (25).

10 Claims, 8 Drawing Figures

GRAPPLE MECHANISM

BACKGROUND OF THE INVENTION

The present invention relates to a grapple operating mechanism and especially to a mechanism for connecting a grapple to a front end loader and adopted to load or remove pipes or the like from railroad cars.

A variety of attachments are commonly available for both wheel and crawler type loaders, such as front end loaders, and allow one vehicle to perform a variety of jobs by shifting between attachments. One attachment provided for front end loaders can be seen in my prior U.S. Pat. No. 4,266,819 of May 12, 1981 for a Grapple Apparatus. This apparatus, which I call a Pipe and Pole Grapple, includes lifting forks having a pair of tines for inserting under a pallet loaded with material or under elongated objects, such as pipes, poles, or logs for lifting the material. In my prior invention, a fork lift attachment had grapple arms gripping the elongated pipes or poles which were self-adjusting upon actuating of hydraulic cylinders to move the gripping arms for different size loads. A common use for such grapples is for loading and unloading pipes, such as oil well pipe, or the like, which might be shipped in railway cars to a site and which would require the pipes to be unloaded by hand or by the use of boom mounted devices which can drop a grapple into the railway car for lifting the pipes therefrom.

The present invention advantageously provides for an attachment of a pipe and pole grapple to be attached to a front end loader in a manner to remove the pipes or poles from railway cars and to otherwise provide greater flexibility to a grapple mounted to a front end loader without having to utilize a boom operated system.

Typical prior patents which grasp logs, pipes, or other material from overhead can be seen in the Lull U.S. Pat. No. 3,305,118; Lindqvist U.S. Pat. No. 3,421,791; and the Lull Pat. No. 3,327,879. In the U.S. Pat. No. 3,182,833 to Lull, an extended boom is attached to a grapple type mechanism; while the Albert U.S. Pat. No. 3,001,654 has a forklift attached to an extension mechanism attached to the front of a vehicle. In the Tendressle U.S. Pat. No. 3,432,050, a forklift mechanism is attached to an extended boom over the boom; while in the Kampert, et al., U.S. Pat. No. 3,203,566, a tractor forklift loader is provided with a mechanism for attaching to tractor type vehicles. The Logus U.S. Pat. No. 3,208,610 is for a self-filling bottom dumping front end loader which has a hoisting boom and shifting mechanism for the attached bucket. Other prior mechanisms can be seen in the Lull U.S. Pat. Nos. 3,178,046 and 3,327,879; and in the Weisgerber U.S. Pat. No. 4,106,646 for a load handling vehicle. In contrast to these prior art devices, the present invention is aimed at a simplified attachment for controlling a grapple mounted onto a front end loader by the operator of the front end loader to adapt a grapple for a variety of pipe, pole or log lifting jobs which have more difficult access while maintaining the flexibility for simpler grappler mechanism.

SUMMARY OF THE INVENTION

A pipe and pole grapple operating mechanism is provided which is attached to a vehicle, such as a front end loader, and includes a generally L-shaped main boom rotatably attached to the vehicle and operated by one or more hydraulic cylinders.

A grapple is rotatably attached to the other end of the boom and a grapple actuating mechanism is adapted to rotate the grapple on the boom. The grapple operating mechanism has one or more hydraulic cylinders connected to a first set of bell crank arms attached to the boom. A first linkage connects the first set of arms to a second set of bell crank arms and a second linkage connects the second set of arms to the grapple so that the operation of the hydraulic cylinders moves the first set of arms, the linkage between the arms, and the second set of arms and the linkage to the grapple to rotate the grapple on the boom.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
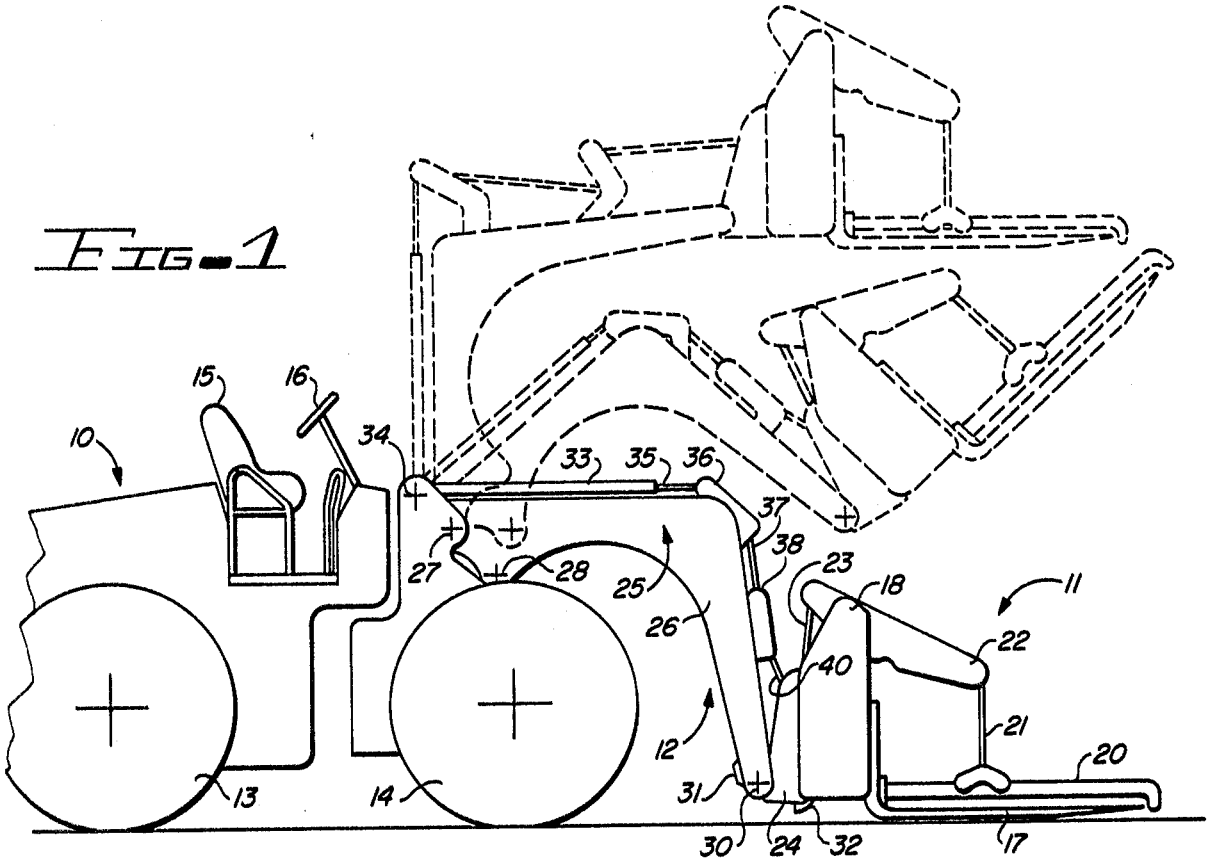
FIG. 1 is a side elevation of a front end loader having a grapple operated in accordance with the present grapple operating mechanism having phantom views showing two operating positions of the boom and grapple.

Referring to the drawings, and especially to FIGS. 1 through 5, a front end loader 10 has a grapple mechanism (11) attached thereto with a grapple operating mechanism (12) in accordance with the present invention. The front end loader (10) has rear wheels (13) and front wheels (14), driver seat (15), and a steering wheel (16). The grapple mechanism 11 is similar to my grapple apparatus in my prior U.S. Pat. No. 4,266,819 of May 12, 1981 and has fork tines (17) connected to grapple frame members (18) along with a pair of grapple arms (20) supported by arms (21) by a pair of bell cranks (22) driven by a pair of hydraulic cylinders (23). A plurality of frame members (24) are used in connecting the grapple (11) to the operating mechanism (12).

The operating mechanism (12) has a boom (25) which is formed with a pair of L-shaped boom members (26) connected with cross brace members, as will be described in more detail in connection with FIG. 6. The boom (25) is raised and lowered by rotating one end of the boom members (26) on a point (27) by actuating a hydraulic cylinder having its power rod connected at (28) with the other end of the cylinder being connected to the front end loader (10). Actuation of the hoist hydraulic cylinders lifts the boom (28) as shown in the phantom view. A grapple mechanism (11) is attached to the boom (25) with support members (24) with pins attached to the boom members (26) at (30), so that the grapple mechanism (11) can rotate on the point (30) of the boom (25) until it reaches a 90° point, at which point a stop (31) engages a stop portion (32). A pair of hydraulic cylinders (33) are connected at a point (34) on the front end loader (10) and each has a power rod (35) connected to a pair of bell crank arms (36), which is rotatably attached to the boom (25). The bell crank arms (36) have a pair of links (37) which in turn are connected to bell crank arms (38) which are also attached to the boom (25). The bell crank arms (38) have a pair of links (40) connected from the arms (38) to the grapple mechanism (11) attachment members (24).

Figure 5:
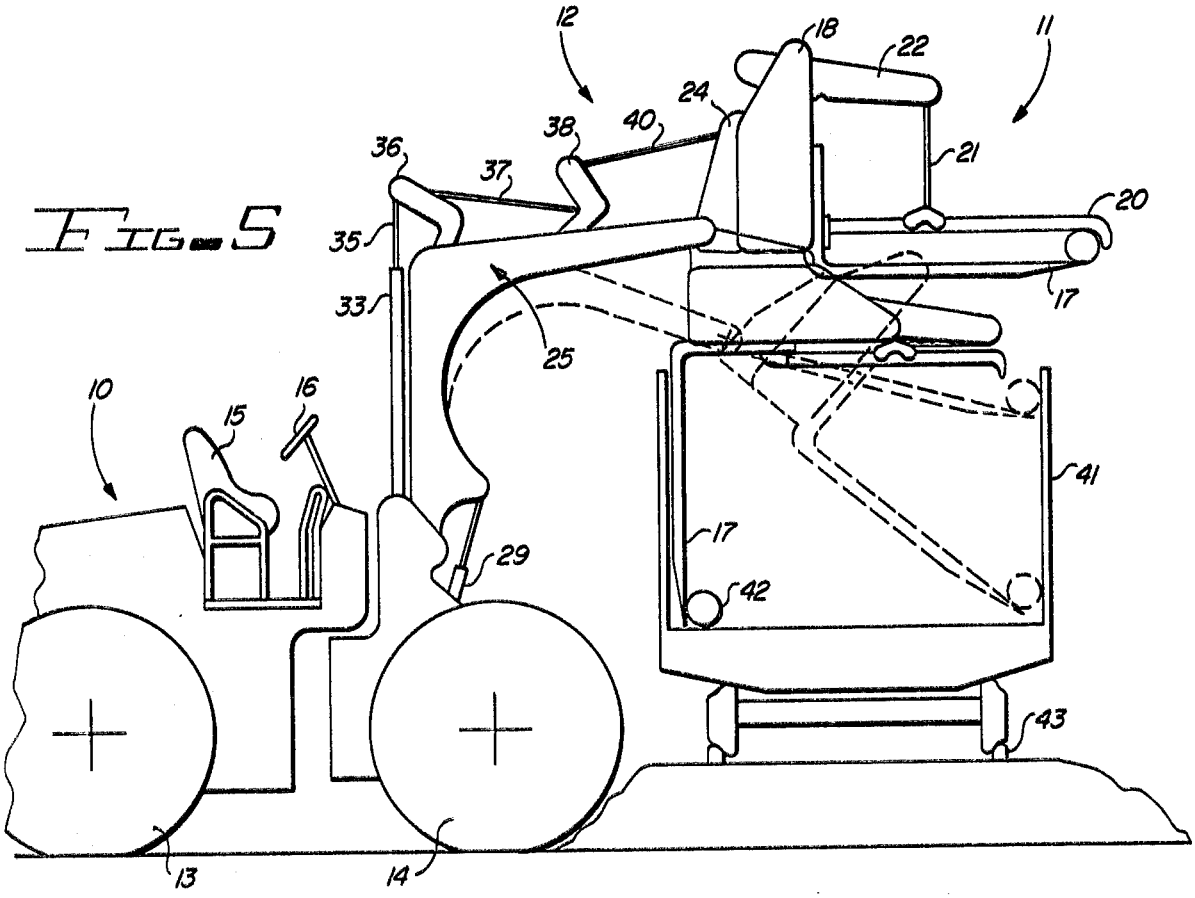
FIG. 5 is a side elevation of a front end loader in accordance with FIG. 4, having phantom views showing the lifting of pipe from the railway car.
Figure 2:
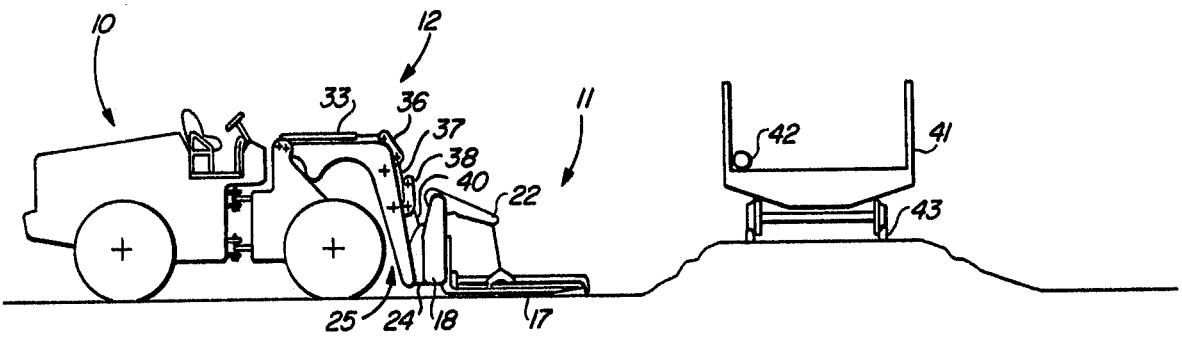
FIG. 2 shows a front end loader with the present invention attached positioned adjacent a railway car.

As can be seen in FIG. 1, lifting of the boom (25) lifts the entire grapple mechanism (11) and actuation of the hydraulic cylinders (33) will rotate the grapple mechanism on the point (30). In FIGS. 2, 3, 4 and 5, the front end loader grapple is shown adjacent to a railway car (41) having a pipe (42) therein and riding on a railroad track (43). The front end loader is positioned adjacent the railway car (41) in FIG. 2 and then lifting the grapple (11) in FIG. 3. The front end loader (10) is moved to position the grapple directly over the top of the railway car (41) in FIG. 4. FIG. 5 shows the operation of the grapple mechansim (11) to a 90° position and in phantom views sliding one or more pipes onto the four tines (17) for gripping by the grapple arms (20) for lifting the pipe out of the railway car (41).

Figure 3:
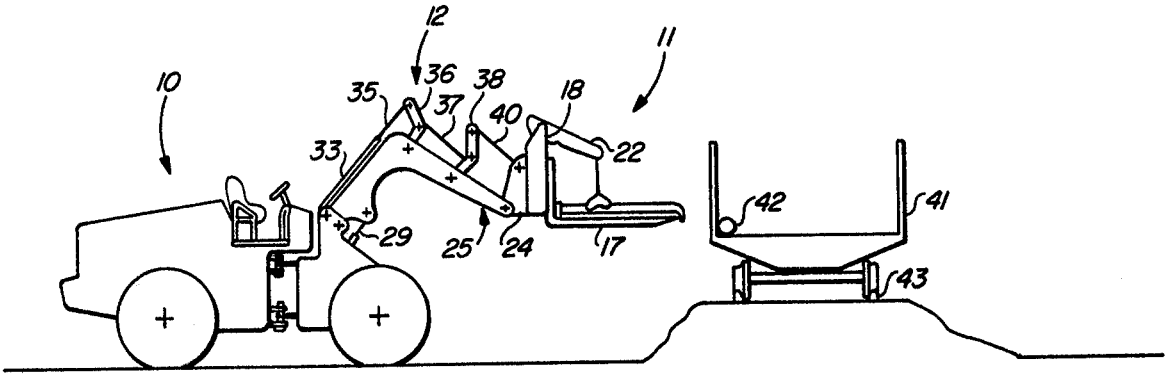
FIG. 3 is a side elevation of the front end loader of FIG. 2 with the grapple lifted by the boom.
Figure 4:
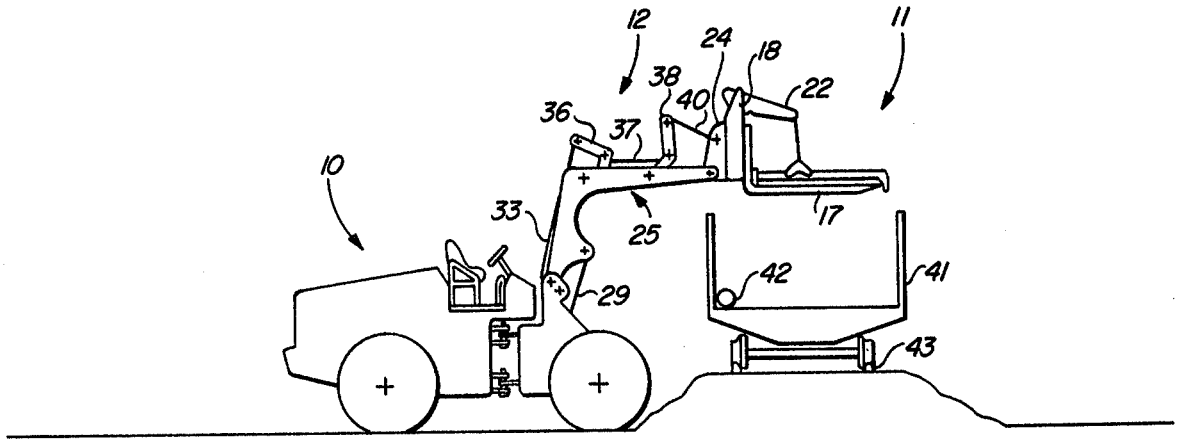
FIG. 4 is a side elevation of a front end loader of FIGS. 2 and 3 having the grapple placed over the railway car.
Figure 6:
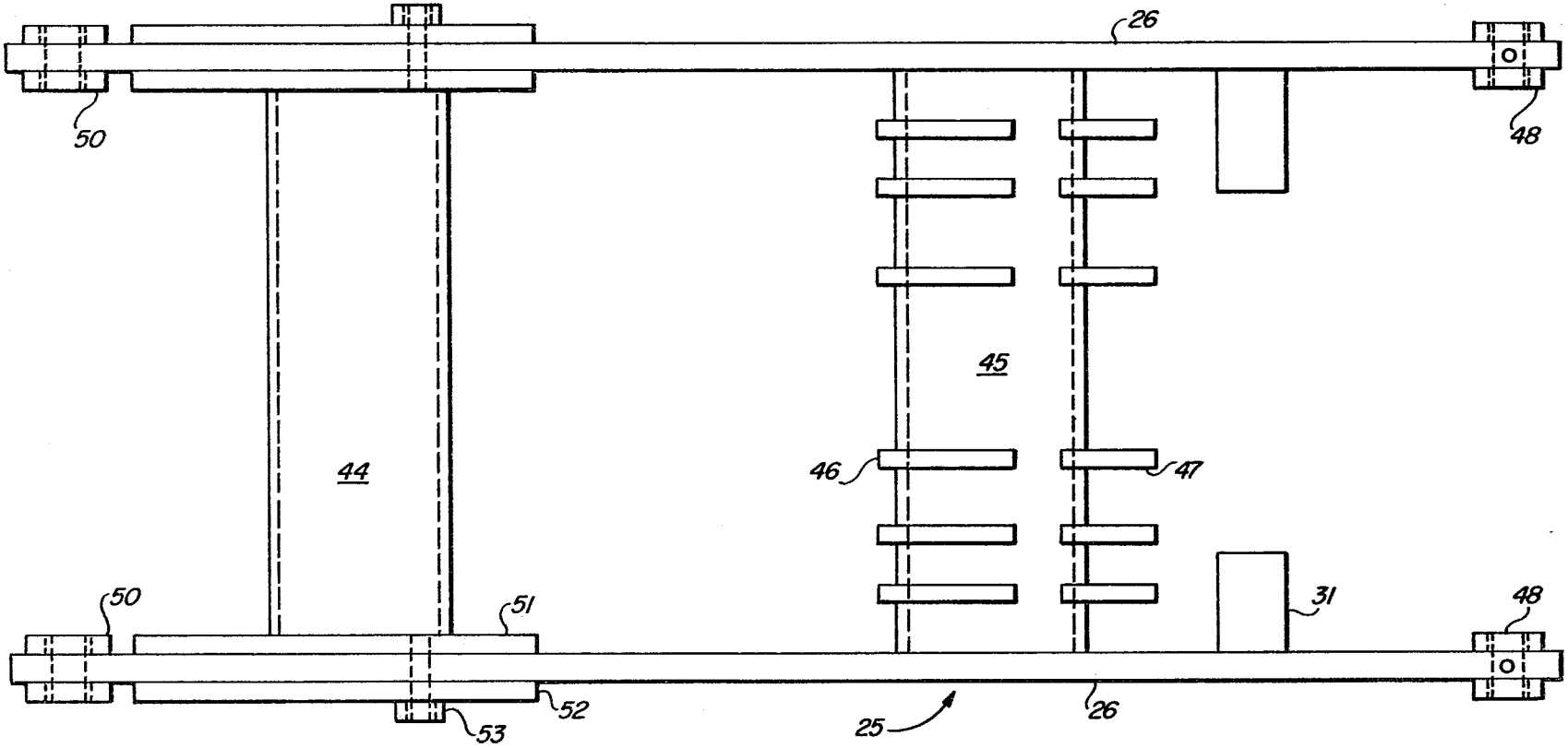
FIG. 6 is a top plan view of the boom.

Turning now to FIG. 6, a top elevation of the boom (25) can be seen to have two boom members (26) connected by cross-member (44) and a second cross-member (45). The cross-member (45) has six bellcrank arm mounting brackets (46) attached thereto for supporting the upper bellcrank arms (36) and six bellcrank arm mounting brackets (47) mounted to the bottom side of of the cross-member (45) for attaching the bottom bellcrank arms (38). The grapple stop members (31) can also be seen in this view, as can bushings (48) for attaching the boom to the grapple and bushings (50) for attaching the boom to the front end loader. A pair of hoist cylinder brackets (51) and (52) are mounted to each boom member (26) adjacent to crossmember (44) and have a bushing (53) therethrough for attaching the hydraulic cylinder rod of a hydraulic cylinder (29), as seen in FIGS. 3 and 4.

Figure 7:
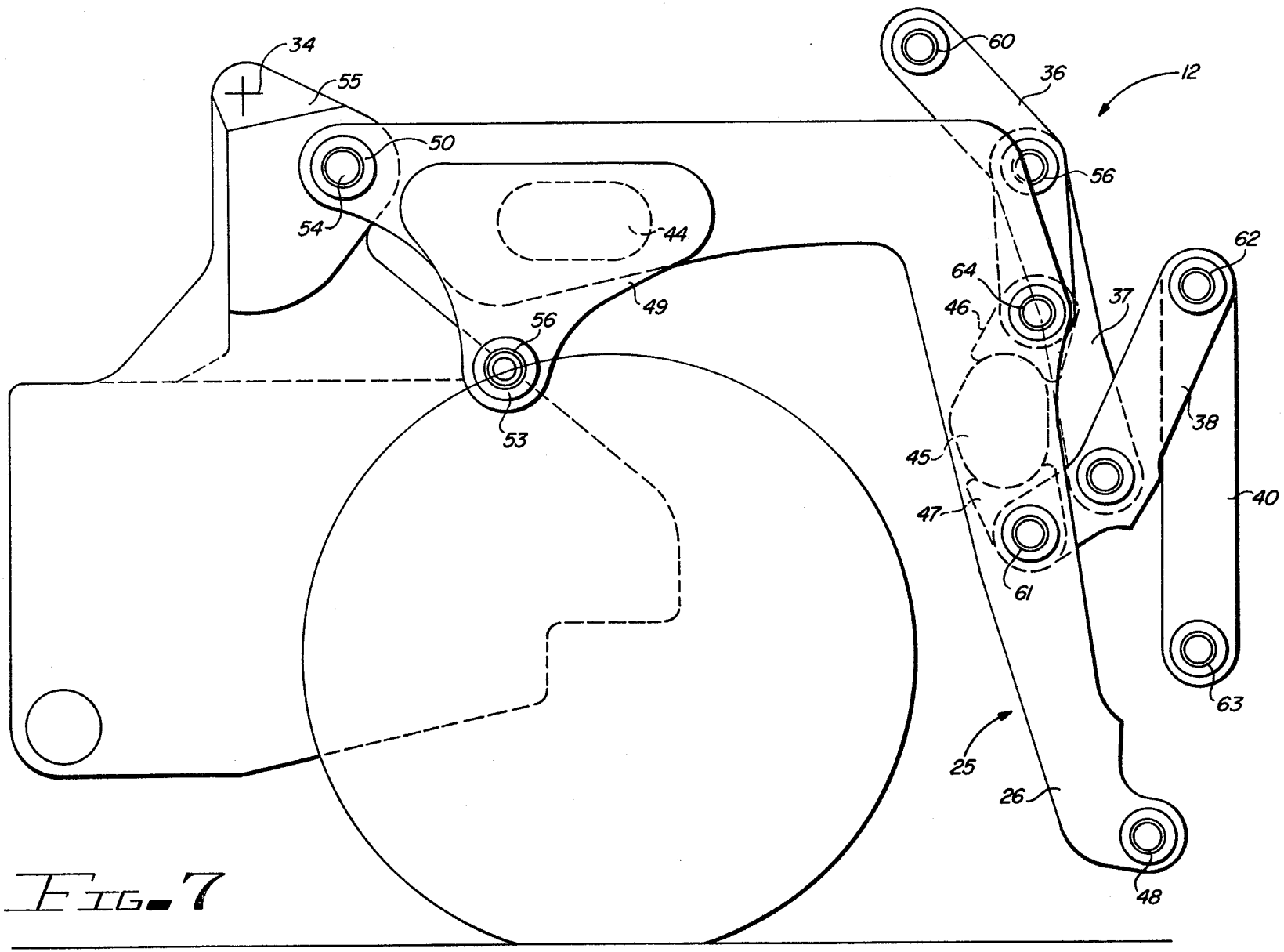
FIG. 7 is a side elevation of the grappler operating mechanism of FIGS. 1 through 5.
Figure 8:
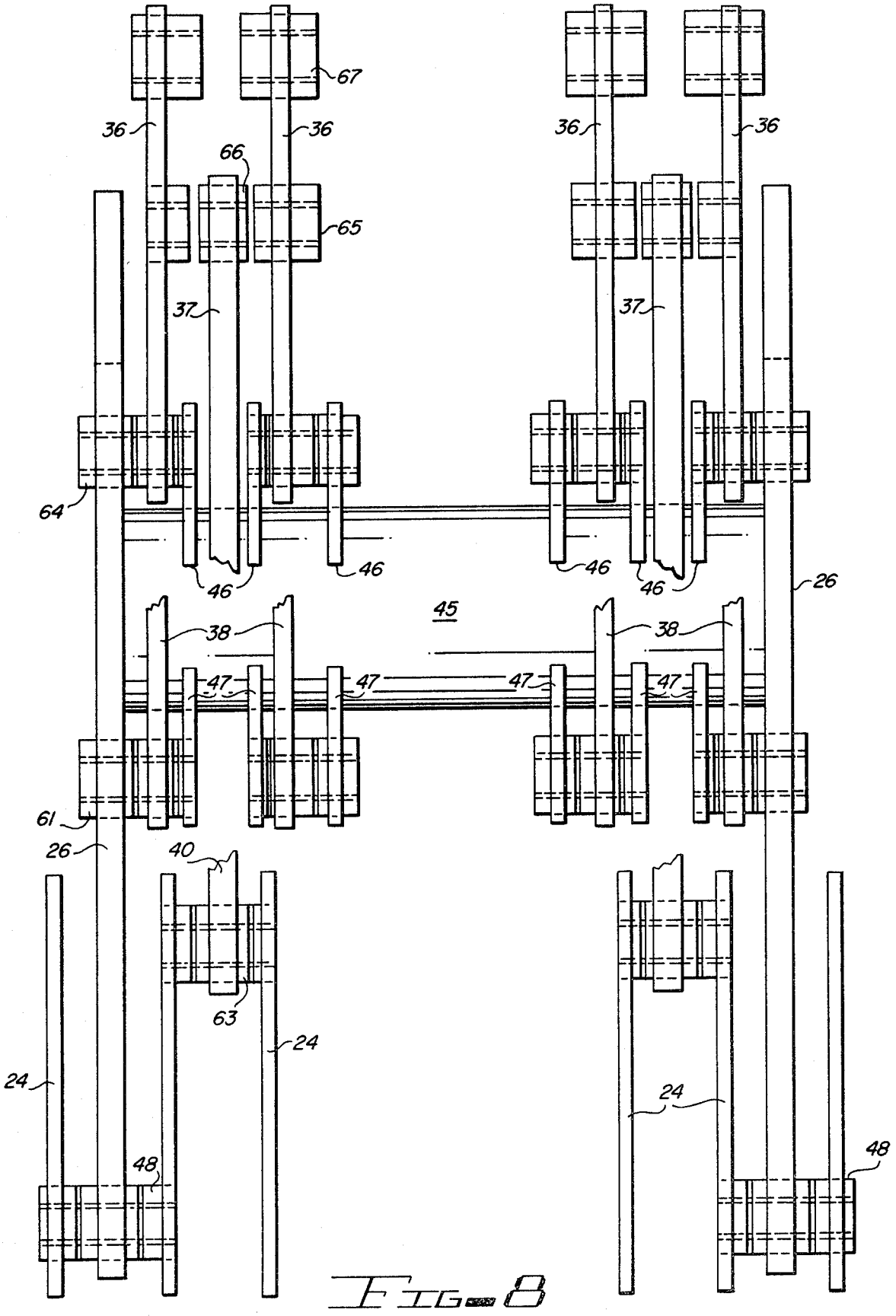
FIG. 8 is a partial front elevation of the operating mechanism of FIG. 7.

In FIGS. 7 and 8, the grapple operating mechanism (12) has the boom (25) with the boom members (26) attached with pins (54) in bushings (50) to a support bracket (55) attached to the front end loader. The boom (25) can be seen as having the cross-member (44) and hydraulic cylinder rod bracket member (49) having a pin (56) and the bushing (53) for mounting the hydraulic cylinder rod thereto. The cross-member (45) is shown in phantom lines and has the lower bellcrank arm brackets (47) attached to one side and the upper bellcrank arm brackets (46) attached to the other side thereof. Lower attachment bushings (48) are attached by a linkage ((37) to the lower bellcrank arm (38). The linkage (37) is attached with a pin (56) to the elbow portion of the arm (36) at one end and with a pin (57) to the elbow portion of the arm (38) at the other end. A flat surface at the elbow portion of bellcrank (38) rest on the stops (31) of FIG. 6 when the grapple is in a 90° position. Bellcrank arm (36) has a bushing (60) on one end for receiving a pin for holding one of two hydraulic cylinders having their cylinder rods connected to their arms (36) with the opposite end of the hydraulic cylinders connected to the bracket (55) at the point (34). The bellcrank arms (38) are connected with pins (61) to the boom (25) on one end and with pins (62) to the links (40) on the other end thereof. The opposite end links have bushings (63) for attaching to the grapple (11). The boom members (26) can be seen connected with the cross-members (45) having six upper bellcrank arm brackets (46) attached thereto, such as by welding, and six lower bellcrank arm brackets (47) attached thereto. Four bellcrank arms (36) are attached with pins (64), one between two brackets (46) and one between a bracket (46) and the boom member (26). A pair of link members (37) are each connected between two of the arm members (36) through bushings (65) on the arms (36) and through a bushing (66) on the link (37). Four lower bellcrank arms (38) are attached between the brackets (47) and between one bracket (47) and the boom member (26) on either side and a portion of a linkage (40) is shown in FIG. 8 with a pin (63) between pairs of the attaching frame members (24) which are on the grapple (11). The boom members (26) are also shown attached to the frame members (24) with pins (48). A portion of the connecting linkage (37) and (40) are removed in FIG. 8 fo clarity. Each of the arms (36) can be seen in FIG. 8 as having a bushing (67) for mounting a pin for holding one end of the hydraulic cylinder (33) of FIG. 1.

A standard front end loader is utilized to support the present grapple mechansim by removing the standard loader boom assembly from an existing front end loader. This is accomplished by disconnecting the boom pins normally inserted at (27) in FIGS. 1 and 7, while leaving the tilt dump hydraulic cylinder of the front end loader in it's normal position mounted to the loader front frame. The present L-shaped boom can then be connected with pins to the points (27) and the bell crank linkage system connected from the points (34) to the first arm (36) to activate the grapple mechanism with a tilt dump motion of the cylinder (43). The bellcrank linkage, however, creates an entirely different motion by virtue of the boom stops and mechanism connected thereto. By installing this different configuration boom arm, the loader is then no longer capable of handling dirt and becomes a specialized type of grapple boom assembly for loading and unloading railroad car gondolas. Thus, most standard front end loaders can be purchased and the standard bucket and boom assembly removed and replaced with the present boom and grapple mechanism controlled in a similar manner to accomplish a new purpose.

It should be clear at this time that an operating mechanism for mounting a grapple to a front end loader has been provided which gives a front end loader mounted grapple greater flexibility for doing jobs such as lifting pipes, poles or logs from railroad cars, or the like. It is contemplated that the mechanism can be utilized, however, for the mounting of other attachments to vehicles, such as front end loaders. Accordingly, the present invention is not to be construed as limited to the forms shown, which are to be considered illustrative rather than restrictive.

I claim:

1. A grapple (11) operating mechanism (12) comprising in combination:

a vehicle (1Ø);

a boom (25) having a pair of generally L-shaped boom members (26) having cross brace members (44, 45) therebetween and having one end portion rotatably attached to said vehicle (1Ø);

grapple (11) rotatably attached to the other end of said boom (25);

a boom actuating mechanism (29) connected between said vehicle (1Ø) and said boom (25) for moving said boom (25) relative to said vehicle (1Ø); and grapple actuating means for rotating said grapple (11) on said boom (25), said grapple actuating means having an actuating member (33) connected to first arm means (36) attached to said boom (25), a first linkage (37) connecting said first arm means (36) to a second arm means (38) and a second linkage (4Ø) connecting said second arm means (38) to said grapple (11), whereby actuating said grapple actuating means will rotate said grapple (11) on said boom (25), and said first arm means is a plurality of arms (36) rotatably attached to a plurality of first arm supporting brackets (46) on said cross brace member (45) and moved by said actuating member (33) and said cross brace member (45) having a plurality of second arm supporting brackets (47) attached thereto for supporting said second arm means (38), said second arm means also including a plurality of arms (38) rotatably attached to said second arm supporting brackets (47) attached to said cross brace member (45) of said boom (25).

2. A grapple operating mechanism in accordance with claim 1, in which said first arm means plurality of arms (36) act as bell crank members having a plurality of bent arms.

3. A grapple operating mechanism in accordance with claim 2, in which said second arm means plurality of arms (38) act as bell crank members and have a plurality of bent arms actuated by said first and second linkage.

4. A grapple operating mechanism in accordance with claim 3, in which said first linkage includes a plurality of link members (37), one link member connecting to each said first arm (36) to one said second arm (38) at a point between the ends of said arms and said second linkage includes a plurality of link members (40) connecting one end of each second arm (38) to said grapple (11).

5. A grapple operating mechanism in accordance with claim 1, in which said grapple operating mechanism boom (25) connects to a front end loader with boom pins replacing the front end loader bucket and bucket operating mechanism.

6. A grapple operating mechanism in accordance with claim 1, in which each said generally L-shaped boom member (26) hàs a hydraulic cylinder attaching bracket (52) attached thereto for supporting a pair of boom lift hydraulic cylinders (29).

7. A grapple operating mechanism in accordance with claim 1, in which said boom actuating mechanism includes a pair of hydraulic cylinders (29) connected between said front end loader and said L-shaped boom members (26).

8. A grapple operating mechanism in accordance with claim 1, in which said first arm support brackets (46) are connected to said first arms (36) and said second arm support brackets (47) are connected to said second arms (38) with arm support pins leaving a spacing between pairs of arms, whereby said first linkage member (37) can extend between said arm support bracket members.

9. A grapple operating mechanism in accordance with claim 1, in which said second arm means (38) have a stop surface formed thereon positioned to engage a stop portion formed on said L-shaped boom members for stopping said mechanism in a predetermined position.

10. A grapple operating mechanism in accordance with claim 9, in which said grapple (11) has a plurality of stop members (32) fixedly attached thereto positioned to engage a stop cross member (31) between said L-shaped boom members for stopping said grapple in a predetermined position.

* * * * *